United States Patent [19]

King

[11] Patent Number: 4,826,714

[45] Date of Patent: May 2, 1989

[54] IMPREGNATED CORRUGTED SHEETS FOR PACKING BOXES AND METHOD OF MANUFACTURE

[75] Inventor: Gary R. King, Lincoln Park, Mich.

[73] Assignee: Richard D. King, Sandusky, Ohio

[21] Appl. No.: 189,923

[22] Filed: May 3, 1988

Related U.S. Application Data

[63] Continuation-in-part of Ser. No. 818,516, Jan. 13, 1986, abandoned.

[51] Int. Cl.[4] ..... B65D 5/62; B32B 9/06

[52] U.S. Cl. ..... 428/34.2; 229/3.1; 427/442; 428/184; 428/186; 428/486

[58] Field of Search ..... 428/34.2, 486, 535.5, 428/182, 184, 186; 229/3.1; 427/442

[56] References Cited

U.S. PATENT DOCUMENTS

| | | | |
|---|---|---|---|
| 2,967,116 | 1/1961 | Hollinger et al. | 428/182 |
| 3,603,219 | 9/1971 | Hallis, Jr. | 193/49 |
| 3,635,193 | 1/1972 | Stease | 118/63 |
| 3,692,564 | 9/1972 | Gonta et al. | 428/182 |
| 3,793,056 | 2/1974 | Stease | 106/168 |
| 3,962,509 | 6/1976 | Thompson | 428/182 |

*Primary Examiner*—Ellis P. Robinson

*Assistant Examiner*—James J. Seidleck

*Attorney, Agent, or Firm*—Neal A. Waldrop

[57] ABSTRACT

The medium and liners of a water resistant containerboard are each essentially completely impregnated by a liquid water resistant agent which also uniformly coats the surfaces of the medium and liners with a layer sufficiently thick to cover the outer extremities of fibers protruding from such surfaces.

The coating and impregnation is accomplished by feeding a flat untreated corrugated containerboard in the direction of its open flutes and in a continuous movement into and out of a hot melt bath of the water resistant agent at a controlled speed sufficient to force the liquid agent through the flutes of the containerboard, so as to assure exposure of all surface portions of the board to the hot melt for the same amount of time at the same temperature conditions. Upon removal of the board from the hot bath, the board is moved to a position with its leading edge uppermost to drain excess liquid agent from the board, which is then moved to a horizontal position to stabilize the depth of the liquid surface coating by the agent and then to a vertical position with the trailing edge uppermost to reverse the direction of final drainage while the board is cooled to solidity the agent.

9 Claims, 2 Drawing Sheets

IMPREGNATED CORRUGTED SHEETS FOR PACKING BOXES AND METHOD OF MANUFACTURE

This application is a continuation n part of pending application Ser. No. 818,516, filed on Jan. 13, 1986, now abandoned, entitled "Impregnated Corrugated Sheets For Packing Boxes and Method of Manufacture". This invention relates to an improved continuous high-speed process for making a superior corrugated containerboard impregnated by a water resistant agent and variously known as water resistant corrugated paperboard, strawboard, or cardboard, which is commonly die cut, scored or creased, and then folded or folded and glued to form a box or container for storing or shipping various goods.

BACKGROUND OF THE INVENTION

Water resistant corrugated containerboard has long been used to contain perishable or refrigerated products or foods. Where the product has a high moisture content, such as fresh meats or iced seafoods, the water resistance and durability of containerboards in common use is much less than is desired. A box filled with iced fresh fish, for example, is seldom treated with care and if the otherwise water resistant corrugated box is cut or crushed during rough handling, such that the water resistant coating is ruptured, moisture is rapidly wicked into the sidewalls of the container, which then rapidly disintegrates.

Paper manufactured from treated wood fibers is most commonly used for corrugated containerboard and is wax treated to enhance its water resistance when required because the untreated containerboard has little wet strength. A commonly used containerboard comprises a corrugated paper medium spacing and glued to kraft paper liners. These papers are often pretreated with wax or other water resistant agent prior to being formed into the containerboard. The pretreament is not only a costly operation in itself, but the water resistant treatment retards the subsequent gluing of the corrugated medium to the liners during fabrication of the containerboard, as compared to the gluing of untreated liners and medium. For use under high humidity conditions, the fabricated pretreated containerboard is additionally waterproofed, as for example by dipping the corrugated containerboard in a hot melt wax bath or by cascading or curtain coating processes.

In the dipping process, batches of containerboards are lowered vertically into a hot melt bath of wax, then withdrawn into an oven where excess liquid wax drains back into the bath. An air knife may be used to blow excess liquid wax from the surface of each containerboard. Thereafter the wax cools and hardens.

Objections to the dipping process are its slowness, the cumbersome equipment required for handling the containerboards, the difficulty of blowing excess wax uniformly from all of the containerboards in the batch, and more importantly the wasteful and nonuniform distribution of the hardened wax throughout the containerboard. By the nature of the dipping process, the lower ends of the containerboards are first into the bath and last out, with the result of an uneven immersion time and temperature exposure to the hot wax for different parts of the containerboard and a costly uneven distribution of wax, whereby useless wax often clogs the lower portions of the corrugation and piles up in an excessively heavy layer near the lower exterior surfaces, which heavy wax layer is usually a waste and often a hindrance.

I have found that the excess wax does not significantly enhance water resistance and adds weight to the box or container without increasing its strength correspondingly. It is also difficult to glue heavily waxed surfaces together to form a box. Thus where gluing is desired, it is first necessary to scrape or melt the excess wax from the locations to be glued, as described by Lombarde in U.S. Pat. No. 1,536,801. Stapling at such locations in lieu of glue is unsatisfactory because the staples break the water resistant coating and allow water to wick into the containerboard. When the flute openings are clogged with wax, bending of the board at the clogged locations to form a box tears the exterior corrugation liners with consequent impairment of water resistance.

According to the cascade method as described by Stease in U.S. Pat. Nos. 3,635,193 and 3,793,056 and Gjeadel in U.S. Pat. No. 3,343,977, the containerboard is passed vertically in a preheated condition under a cascade of hot liquid wax which runs down the flutes and exterior surfaces of the containerboard. Thereafter the board is cooled to harden the wax. The cascade method relies on gravity flow for the wax which results in uneven exposure of all parts of the containerboard to the wax for equal time intervals and temperature conditions. An uneven distribution of wax over the surfaces of the flutes and the exterior surfaces of the containerboard and a nonuniform impregnation of such surfaces results as the comparatively slow gravity flow of wax congeals on the containerboard. The resulting waxed containerboard is thus subject to most of the objections described in regard to the "dipped" containerboard.

Furthermore, die cutting and scoring of a containerboard transversely of the flutes severely restricts the flute opening and prevents free flow of the wax therealong and is therefore not feasible prior to treatment by either the dipping or the cascade process. Because of the nominal forces available to the dipping and cascade processes for urging the flow of liquid wax longitudinally through the flute openings, these processes cannot avoid heavy accumulations of solid wax in portions of the flute openings, these processes cannot avoid heavy accumulations of solid wax in portions of the flute openings, even when these openings are otherwise unrestricted, and are utterly incapable of achieving satisfactory wax flow through the flute openings when they are restricted by transverse scoring or die cutting. In consequence, the die cutting and scoring required to facilitate formation of a box from the plane containerboard and, which are preferably performed during the same single operation, must be done after the dipping or cascading wax treatment. The scrap from the die cutting, being waxed, cannot be recycled and is thus another source of expensive waste.

The curtain process as described by McConnell et al in U.S. Pat. No. 3,524,759 flows a curtain or cascade of a hot melt water resistant agent on the surface of the containerboard as it passes horizontally under the flow. The curtain process coats only the exterior surfaces of the containerboard, has limited use, and is unsatisfactory for producing containerboard intended for use in humid conditions where there is a likelihood of rupturing the coated surface.

It is well known to the art that overheating of the containerboard during a waterproofing operation will damage the wood fibers, boil out the normal latent water content, which is normally about 6% to 8% but which might range form 2% to 10% of the weight of the untreated containerboard, and render the containerboard too brittle for satisfactory use, such that it cannot be bent as required to form a box without cracking. Accordingly, all attempts to impregnate or coat a corrugated containerboard with a hot melt water repellant, such as melted wax, take care to avoid dessication of the containerboard by prolonged exposure to high temperature. Gonta U.S. Pat. No. 3,692,564 teaches a vertical dipping process using wax at a selected temperature to prevent impregnation by the wax into the interior of the paperboard elements and teaches that such penetration is undesirable and wasteful of wax in column 3. The present invention differs from Gonta '564 by intentionally selecting conditions of wax application which maximize penetration into the interior of the paperboard elements to assure that the interiors are essentially saturated, as explained below.

An important discovery in accordance with the present invention is that once the fibers in the containerboard and the interstices between the fibers are saturated with wax, additional surface layers of wax do not enhance water resistance and from the standpoint of economy of material and efficiency of production are undesirable even though the water resistance remains satisfactory. Such extra, unnecessary wax undesirably increases the weight of the container, and interferes with bending and gluing of parts as desired to fabricate a box.

OBJECTS OF THE INVENTION

Important objects of the present invention are to provide a continuous highspeed process for making a superior water resistant containerboard wherein the above noted objections to conventional processes and the resulting containerboard are avoided.

In particular, an object is to provide a waxed corrugated containerboard and process for making the same wherein an untreated corrugated containerboard (i.e., a corrugated board not fabricated from pretreated water resistant paper) is immersed into a hot melt wax bath under controlled conditions such that all portions of the containerboard are exposed to the hot wax for equal preselected time periods and wax temperatures, and the immersion may be effected in a single fast, pass through the hot wax bath in a continuous, efficient manner.

Other objects are to provide an improved corrugated water resistant containerboard wherein the surfaces of the corrugated medium are uniformly coated and essentially completely impregnated by a liquid water resistant agent, such as melted wax, to a uniform depth which depth of penetration extends throughout the length of the corrugations, wherein the surfaces of the liners are also uniformly coated and essentially completely impregnated by the water resistant agent to a uniform depth into their interior areas, and all of the surfaces of the liners and of the medium are uniformly wax coated by a layer of the water resistant agent sufficiently thick to cover the outer extremities of fibers protruding from such surfaces prior to treatment.

Another object is to provide such a containerboard that has improved water resistance, strength, and flexibility compared to conventional waxed containerboards otherwise comparable prior to being waxed; that can be die cut and creased or scored prior to being waxed; and that do not require prewaxing or waterproofing of the paper from which the corrugated containerboard is fabricated in order to obtain optimum water resistance and compression strength when folded into box form.

SUMMARY OF THE INVENTION

In accordance with this invention it has been found that the above stated objects can be attained by feeding a flat untreated corrugated containerboard or sheet generally horizontally in the direction of the open flutes into a bath of hot wax in a direction to immerse the entire board in the bath and at a controlled uniform high speed sufficient to force the wax through the flutes of the board, and draining the excess wax in a uniform coating of wax on all exterior surfaces and penetrating into and essentially impregnating the interior within the liners and corrugated medium.

In a preferred example of the process, untreated containerboards are arranged horizontally in a stack, one above the other, and fed one at a time by automatic means into a conveyor which carries the containerboards, one after another, angularly downwardly into the bath to a totally submerged horizontal condition and thence in the same generally horizontal direction angularly upwardly from the bath into a hot drain and stabilizing zone where excess hot liquid wax entrained with the moving containerboard drains back into the bath. The stabilizing zone is preferably located above and heated by the hot bath and is thus somewhat cooler than the bath but hotter than the melting point of the wax.

By virtue of the continuous movement into and from the bath, all portions of the containerboard are exposed to the same temperature of the hot bath for the same time duration and are thus equally subject to penetration of the liner surfaces and impregnation of the interiors of the liners by the hot melt. The high speed of the containerboard through the hot bath in the direction of the flutes forces the melted wax completely through the flute openings regardless of partial restrictions resulting from die cutting and scoring. The flute openings extend longitudinally within the containerboard between the flutes and the interior surfaces of the liners for the corrugated medium, such that all portions of their sidewalls throughout their length are also exposed uniformly to the hot wax for the same time interval and temperature condition. As the hot wax flows over and in contact with the surfaces of the flutes the wax penetrates into the fibers and into the interstices between the fibers to thereby impregnate the interior area of the flutes, as well as penetrating and impregnating the interior areas of the liners.

A uniform, thin surface coating on the liners is produced by insuring that the treated board, after exiting and draining excess wax from the flutes, is allowed to remain in a horizontal position in the stabilizing zone for a time during which the wax is still liquid and continuing to penetrate and uniformly distribute itself throughout the internal areas of both the liners and the corrugated medium. The desirable and necessary thin surface coating on both the interior and exterior surfaces of the liners is obtained by a rapid curing, or set, of the wax once the treated board has stabilized and this setting occurs, preferably, by a fast movement of the board from the heated stabilizing zone into an adjacent ambient temperature area, or by forced air cooling or the like, as desired.

The amount of wax in the surface coating is preferably controlled so as to insure a depth of surface coating just sufficiently thick to cover the outermost ends of the protruding fibers which extend upwardly, or outwardly, from the liner board surfaces. This is accomplished by adjusting the viscosity of the wax both in conjunction with the temperature and immersion time in the bath as will be explained in greater detail hereinafter.

The resulting surface of the coated containerboard will be capable of effecting a fiber to fiber bond with a similar surface when conventionally glued thereto by typical glues used to form boxes from untreated containerboards. Such glues are hot melts that will melt a thin layer of wax and in many cases contain chemicals that dissolve a thin wax layer. The completed containerboard contains the minimum quantity of wax required to obtain effective water resistance and is superior to conventional wax treated containerboards in regard to strength, flexibility, and water resistance under both static conditions and when damaged by rough handling.

Other objects of this invention will appear in the following description and appended claims, reference being had to the accompanying drawings forming a part of this specification wherein like reference characters designate corresponding parts in the several views.

It is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

BRIEF DESCRIPTION OF THE INVENTION

Figure 1:
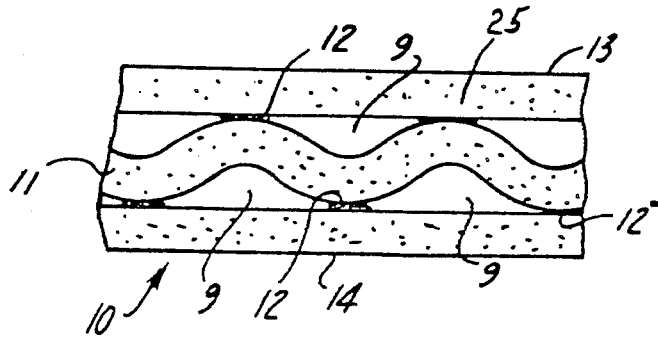
FIG. 1 is an enlarged fragmentary schematic sectional view taken transversely of the corrugations of an untreated containerboard of the type suitable for treatment in accordance with the present invention.

Referring now to the drawings, FIG. 1 illustrates a typical two liner containerboard 10 prior to being treated in accordance with the process of the present invention. The board 10 comprises a corrugated or fluted medium 11 conventionally glued at the peaks of the flutes 12 by means of a water resistant starch type glue to the corrugation liners 13 and 14 to provide flute openings 9 extending longitudinally of the flutes and bounded by portions of the medium 11 and the adjacent liners 13 and 14.

The liners 13 and 14 are commonly made from kraft paper comprising treated soft wood fibers. The corrugated medium 11 is usually made by a semi-chemical pulping process from hardwood fibers and frequently contains considerable recycled paper or scrap corrugated containerboard. The containerboard shown has two liners, although a single liner, triple liner, and other multiple liner corrugated containerboards can be treated and made water resistant within the concept of the present invention. The containerboards 10 are fabricated in plain blanks or sheets of various sizes. A typical containerboard for a fish box for example will be approximately five feet long in the direction of the flutes and may be more or less as wide as long.

The fibrous papers of the medium 11 and liners 13 and 14 may or may not have been pretreated to render them water resistant prior to fabrication into the containerboards 10. Preferably the containerboard 10 will be fabricated from papers that have not been treated to be water resistant because such pretreatment adds to the cost of the board 10 and is entirely unnecessary. A board manufactured in accordance with the process of the present invention will have excellent water resistance regardless whether or not the fibrous papers from which it is made have been pretreated.

Figure 2:
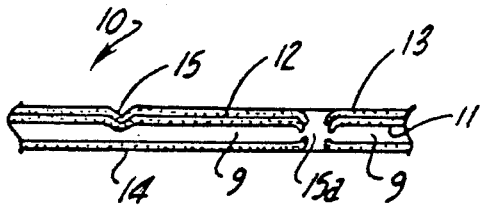
FIG. 2 is a fragmentary schematic view of a containerboard embodying the present invention taken longitudinally of one of the flute openings and illustrating the restrictions in the flute opening resulting from scoring and die cutting to facilitate bending of the containerboard as required to make a box.

Prior to treatment in accordance with the present method, the board 10 is preferably die cut and prescored or creased, as at 15*a* and 15 respectively, FIG. 2, in accordance with conventional practice to facilitate the formation of a box from the plane containerboard sheet. Again it is immaterial to the process described herein whether or not the plane containerboard 10 is die cut and prescored, but die cutting and scoring prior to waxing in accordance with the process described herein is preferred because, as noted above, the unwaxed scrap or cuttings remaining after the board is die cut may be recycled to achieve significant economies. After the board 10 has been waxed, the scrap from the die cutting cannot be recycled and this latter fact is one of a number of important advantages achieved by the present invention over conventional waxing procedures wherein effective waxing and waterproofing cannot be obtained if the containerboard is precut and scored.

Figure 4:
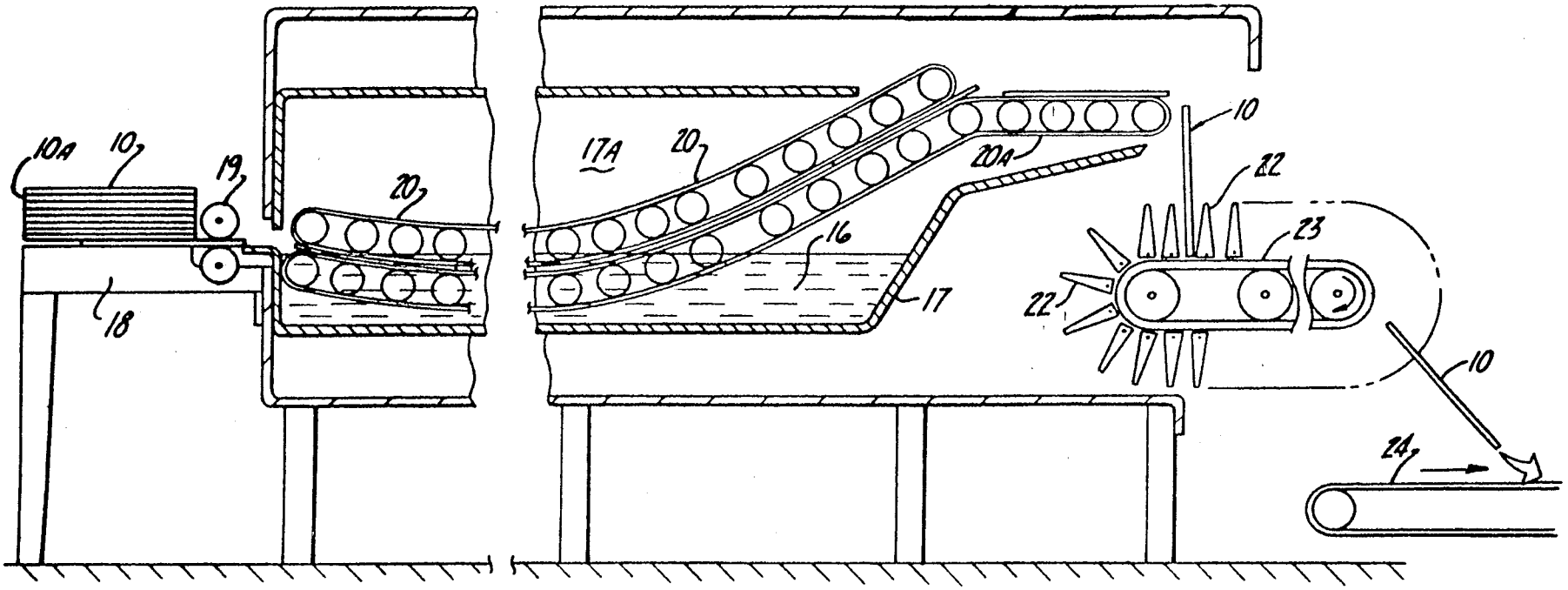
FIG. 4 is a schematic view illustrating an apparatus by way of example for carrying out the process or method of the present invention.

Referring to FIG. 4, an apparatus suitable for carrying out the prefererd process described herein is illustrated comprising a hot melt bath 16 of wax within a substantially enclosed container or tank 17. A stack 10*a* of horizontal containerboards 10 is located on an automatic device 18 for feeding the boards 10 one by one into the tank 17. The device 18 may be conventional and may in fact comprise the same containerboard feeder conventionally used for feeding containerboards into a printer-slotter mechanism. Accordingly, details of the device 18 are not illustrated.

The device 18 feeds the boards or sheets 10 on by one in turn from the bottom of the stack 10*a* in predetermined timed relationship and in the longitudinal direction of the flutes of flute openings 9 to a position between a pair of power driven feed rollers 19 which frictionally move each board 10 in turn into the tank 17 and between the belts of a conveyor system 20. The latter comprises a plurality of belts arranged laterally of the direction of movement of the board 10 and above and below the board 10 to frictionally carry it in the longitudinal direction of the flute openings 9 generally horizontally and downwardly into the hot melt bath 16, thence generally horizontally in the same continuous movement to a position totally submerged within the bath 16, then in the same continuous movement and generally horizontal direction but inclined upwardly to carry the board 10 out of the bath 16 and into the hot atmosphere 17*a* located above the bath 16 and heated thereby. Within the hot atmosphere 17*a*, the feed system 20 continues to carry the board 10 upwardly whereat excess wax entrained with the moving board 10 drains back into the bath 16.

The belts in the system 20 are comparatively thin and are spaced laterally of the direction of movement to assure freedom of exposure of all exterior surfaces of the board 10 to the wax in the bath 16. The speed of travel is predetermined so that the wax 16 is forced into the leading ends of the flute openings 9 and out the trailing ends as the board 10 is carried through the bath 16, thereby to assure absolute and complete contact of all portions of the sidewalls of theopenings 9 throughout their entire lengths regardless of any partial restrictions of the flute openings, as for example at the crease 15 or at the edges of die cut portions 15*a*. As indicated in FIG. 4, the feed mechanism 18 is timed to permit a slight spacing between consecutive boards 10.

Figure 3:
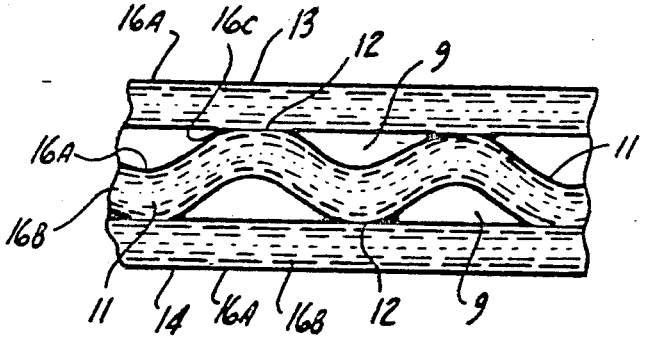
FIG. 3 is an enlarged fragmentary schematic view of the containerboard of FIG. 2, taken transversely of the corrugations.

During the total time of passage of any portion of a board 10 through the bath 16, which in a preferred situation is approximately 1 to 1½ seconds, depending upon the length of the board 10, the low viscosity hot wax in contact with the inner and outer surfaces of the liners 13 and 14 and with the surfaces of the corrugated medium 11 rapidly permeates the fibers and the pores of the fibrous paper and tends to saturate the interstices between the fibers in the locations throughout but indicated generally at 16*b*, FIG. 3. Because every portion of the liner 10 is in contact with the hot melt of the bath 16 for the same time duration as every other portion and at the same temperature, the impregnation of the wax 16*b* into each type of surface is uniform throughout the entire board 10. Also the comparatively high speed of movement of the board 10 through the bath 16 enables use of a wax bath temperature higher than would be feasible with prolonged exposure of the board 10 to the wax 16. In consequence a wider selection of wax and wax type formulations is possible in accordance with the present invention. The limiting temperature for bath 16 will of course be between the melting and flash temperatures of the wax.

As the board 10 moves upwardly into the zone 17*a*, which is somewhat cooler than the bath 16 but substantially above the melting point of the wax, the wax entrained with the board will continue its penetration into the adjacent medium and liners 11, 13 and 14 and even into the wood fibers themselves to the maximum extent possible under the prevailing application conditions. Such degree of wax penetration into the liners and medium is referred to hereinafter in this specification and in the appended claims by the term "essentially saturated", or "essentially saturate".

It is desirable to avoid an increase in the temperature of the board in the interior areas of the liners and the medium sufficiently high to boil out the latent water content of the original board, or to any degree char or degrade the fibers per se. However, the process of this invention permits the use of wax solutions at temperatures well in excess of 212° F., the boiling point of water because the time of treatment is too short to raise the internal temperature in the interior areas to such undesirable temperatures for a sufficient time to damage the container board with respect to its flexibility and strength during later folding into box form.

After a limited drainage time within the environment 17*a*, which time may be somewhat shorter than the immersion time wihtin the bath 16, the board 10 is conveyed in the same continuous high-speed movement to a horizontal position by an extension 20*a* of the lower portion of the belt system 20, from which extension 20*a* the board 10 is permitted to fall by gravity to a generally vertical position between a pair of supporting brackets 22 carried by a slowly moving continuous belt 23.

Prior to movement of the board 10 to the horizontal position on conveyor portion 20*a*, the inclined position of the containerboard 10 will result in a slightly increased thickening of the surface wax in the direction toward its trailing edge. At the horizontal position of the board 10 the liquid wax will tend to level out and stabilize by gravity flow and by surface tension to a thin uniform thickness. Such uniformity of surface thickness is obtained within the flute openings and on the undersurface of the board 10 as well as on its upper surface.

As the board 10 falls to the vertical position between the brackets 22, FIG. 4, its former leading edge will continue as such but will be below the trailing edge. The slightly thicker liquid surface wax remaining adjacent to the trailing edge of the board, if any, will then flow toward the lower leading edge to effect a final substantially uniform thickness of the surface wax 16*a*, FIG. 3, over the entire board 10 as the wax sets and hardens on and in the containerboard.

Although the final thickness of the surface wax is a very thin surface coating 16*a* of between a fraction of a thousandths of an inch to a few thousandths of an inch at most, the final leveling and stabilization is important to provide a continuous water resistant layer preferably just sufficient to cover the outer ends of the outwardly extending fibers protruding from the various surfaces of the fiberboard 10, i.e., the surfaces of the medium 11 and the inner and outer surfaces of the liners 13 and 14. The thickness of the aforesaid outer coating will be determined by the temperature conditions, the time duration of the exposure of the board 10 to the temperature conditions, and the type of wax employed in the process. These factors should be preselected to assure covering of the aforesaid outwardly protruding fibers and are easily established by a few adjustments of the temperature of the bath or, the time of immersion, or both. The thickness of the wax layer will vary to the extent that the quality of the fiber board itself requires a thinner or thicker coating in order to cover the variation in the extent to which the fibers protrude above the surfaces of the liners and/or mediums.

Shortly after falling between the brackets 22, the wax on the board 10 cools rapidly and solidifies as the belt 23 carries the boards from the heated area of the container 17. The very lowermost edge of the board 10 between the brackets 22 may contain a small amount of excess hardened wax that may partially close the lowermost ends of the flute openings. However, such excess wax when it exists is usually nominal compared to the overall surfaces of the containerboard and does not detract from the usefulness of the board 10 as a water resistant container, nor from the above described concepts of a substantially uniform thin wax coating of essentially uniform thickness over the surfaces of the board 10*a*, nor from the concept of the containerboard capable of being glued as described. By the time the board 10 is moved to the right end of the belt 23, which may involve several minutes, the thin layer of surface wax is sufficiently solidified to prevent sticking to adjacent boards. The finished water resistant containerboard 10 is then moved to a belt system 24 and conveyed to storage.

Although the present invention is described by way of example with a hot melt wax process for waterproofing the containerboards 10, it is to be understood that other water resistant non-wax agents, such as various resins and polymers known to those skilled in the art such as, for example, polyethylenes, polypropylenes, polyesters and other thin film orming materials, can be used within the scope of the present invention. Certain aspects of the invention apply equally to such non-wax water resistant agents, particularly in regard to the continuous high-speed process and resulting economies and in regard to the uniform distribution of the water resistant agent obtained by reason of its exposure to all portions of the containerboard at the same temperature and for equal time intervals.

On the other hand, numerous waxes and wax polymer combinations known to the art and now used for impregnating and coating containerboards are preferred for use as the water resistant agent in accordance with the present invention because they are comparatively inexpensive and easy to apply. The physical characteristics of suitable containerboards and numerous waxes and wax polymer combinations and in particular their reactions to various temperature conditions within the ranges customarily used for waxing containerboards are also well known to the art. Accordingly, persons versed in the art can easily select the necessary operating conditions for optimum wax coating and impregnation in accordance with the invention without damaging the containerboard by overheating.

The preferred waxes are the paraffin waxes. Typically, paraffin waxes have melting points in the range of about 115° F. to about 160° F. and a single wax, or a mixture of such waxes may be satisfactorily selected for use. Such waxes may be modified in viscosity by the addition of small quantities of compatible mineral oils or high temperature solvents to attain the best drain characteristics to give the desired coating thickness in the stabilizing zone by a few tests easily made by those skilled in the art of using such materials. Suitable waxes are commercially available from a number of suppliers including Sunoco, Pennzoil, etc. A specific wax that is especially useful is Paraffin 8126 available from Pennzoil Refineries, which is accepted by the FDA for use in food containers. For fish boxes, containerboard 10 is best made from a corrugated board with "c" flutes and having a 200 pounds per inch Mullen test rating.

The preferred operating conditions will be varied in accordance with the quality of the containerboard, including the porosity and weight of the papers from which it is made, the cross sectional area and length of the flute openings, the type of wax and its viscosity, the speed of movement of the containerboard through the hot melt bath, the duration of immersion within the bath and the subsequent time in the drainage zone. Such conditions should be selected and coordinated to obtain the desired surface layers of wax and wax impregnation into the containerboard.

In the preferred method described in reference to FIG. 4, the boards 10 are moved at a speed in the range of about 200 to 300 ft./min., although considerably higher speeds up to about 500 ft./min. are usable with a consequent reduction in the time of exposure of the containerboard 10 to the hot bath; the temperature of the wax in the bath 16 may be any temperature which in combination with the time of immersion of the board 10 with the bath 16 does not cause detrimental reduction of the board moisture content or overheating of the board sufficiently to render it too brittle for use as a container. At lower temperatures the speed of conveyor system 20 may be retarded and at higher temperatures, even above the water boiling point, the conveyor speed will be increased to complete the wax impregnation before the board 10 is overheated.

For any particular containerboard, three variables to be controlled are the temperature of the wax bath, the speed of movement of the containerboard which determines the duration of its submersion within the bath, and the type of wax and its composition determines the melt temperature and viscosity. Each of the three variables can be varied within reasonable ranges independently of the other two to obtain susbstantially the same effective optimum water resistance. An overall consideration is the time that the particular containerboard can be exposed to the temperature conditions of the bath and drain area without impairment of the strength and flexibility of the board by boiling the latent water content or otherwise overheating or damaging the materials from which the board is made.

Without being limited to any specific theory of operation, it is thought that the hot wax engaging the comparatively thin and porous liners 13 and 14, both at their exterior surfaces and at their interior surfaces from within the flute openings 9, FIG. 3, rapidly penetrates such surfaces and essentially saturates the interstices between the fibers in a fraction of the time required by the containerboard 10 to pass through the bath 16, even at high speeds.

The wax completely surrounds the glued regions 12 and prevents separation of the liners from the medium due to water penetration during use, which water penetration is typical with prior art wax coating processes. Also as indicated in FIG. 3, the wax is drawn by capillary action at 16*c* into the juncture between glued portions 12 of the medium 11 and liners 13 and 14 to strengthen the juncture and additionally protect the glue 12 from external moisture.

In the above regard, the solidified wax surrounding the longitudinally extending glued regions 12 materially increases their resistance to longitudinal crushing force by supporting the glued regions transversely as compressive force is applied as, for example, when boxes are stacked one on top of the other. Similarly, the solidified wax filling the interstices between the fibers within the papers 11, 13 and 14 materially increases the resistance of the containerboard to crushing force in any direction by supporting the fibers transversely of the crushing force. In consequence, not only does the waxed containerboard made in accordance with this invention have water resistance superior to conventional wax impregnated containerboards, but it also has much greater wet and dry crush resistance to an unexpected degree as illustrated in the examples.

The liquid wax penetration of the medium 11 and liners 13 and 14 takes place at different rates as a function of their differences in composition and porosity, and as saturation is approached, the rate of wax penetration tends to decrease as the liqud wax penetrates the wood fibers and flows into tiny, interstitial spaces between the wood fibers 25 in the papers 11, 13, and 14, FIG. 1. Such flow is believed to be augmented by capillary and osmotic action that continues in the zone 17*a* while the liquid wax is on the surfaces of the papers 11, 13, and 14. Penetration is substantially complete to a uniform depth throughout all surfaces of the containerboard by the time the wax begins to congeal. The board is thus believed to be essentially saturated by the wax at least to the depth of an interface well below the outer surfaces of the liners and fluted medium which thus effectively seals all of the exposed surfaces against water penetration and confers added resilience to bending and added resistance to compression forces such as are routinely encountered during use or upon stacking a plurality of boxes on conventional pallets.

A plane untreated corrugated containerboard (i.e., an unwaxed board) was suitably scored and die cut in a preselected intricate pattern to enable infolding of its various parts along the score lines to form a box having parallel multiple layered and structurally efficient walls or panels. The plane containerboard was then waxed and made water resistant by using the process of this invention. The plane waxed containerboard was then folded along the score lines to complete a water resistant and commercially acceptable box, 22"×15"×9" in size and suitable for use with high moisture content. Similarly, a water resistant interlocking cover was made for the box.

EXAMPLE I

Corrugated paper board having the configuration of FIG. 1 obtained from Westvaco and having a Mullen strength of 200 pounds per square inch was cut into rectangular samples 5" long by 2.5" wide so that the flutes ran lengthwise. A rectangular water absorption test area measuring 3.5" long by 2" wide was outlined on the surface of each sample. Each sample was then weighed.

Using a Pennzoil paraffin wax No. 8126 having a melting point range of 122° F.–127° F., a viscosity of 38.5 centerpoises, using ASTM method D-445, and a maximum oil content of 20%, using ASTM test method D-721, a series of hot wax solutions was prepared at each of the temperatures specified in Table I below.

The above prepared samples were then immersed in each hot wax both by orienting the flutes in the direction of horizontal movement of the sample horizontally through the bath at sufficient speed to cause the hot melt wax to flow through the flute openings completely from front to rear and then removing the samples at ambient temperatures and maintaining the coated samples essentially horizontally and slowly rotating them about their horizontal axis until the wax started to harden. Each sample was then placed in a freezer at 32° F., and after the wax was hard the samples were removed and again weighed.

A dam, or wall of microcrystalline wax was then attached around the perimeter of the previously marked test area on each sample. The pool formed by the microcrystalline wax wall was then filled with ice water and allowed to sit undisturbed for a period of either 24 or 48 hours as shown in Table I. The water was then removed together with the microcrystalline wax dam and each sample was then reweighed to determine the amount of water abosrbed. The results are set forth in Table 1.

TABLE I

| Wax Dip Wax Wt. (°F.) | Uncoated Sample Wt. (grams) | Waxed Sample Wt. (grams) | Wax Wt. Per Sample (grams) | Lbs. & MSF | Wax Wt. Per $H_2O$ Test Area (grams) | $H_2O$ Test Period (Hrs.) | Waxed Sample Wt. After Test (grams) | % Waxed Test Area $H_2O$ Absorption (grams) | $H_2O$ Pounds per 1000 square feet of surface | % Increase in Wt. of Test Area |
|---|---|---|---|---|---|---|---|---|---|---|
| 120° | 4.70 | 9.65 | 4.95 | 124.94 | 2.77 | 48 | 9.70 | .05 | 2.27 | 1.8 |
| 140° | 4.75 | 10.15 | 5.40 | 137.38 | 3.02 | 24 | 10.15 | .00 | | 0.0 |
| 160° | 4.70 | 9.10 | 4.40 | 111.94 | 2.46 | 48 | 9.15 | .05 | 2.27 | 2.0 |
| 160° | 4.65 | 9.50 | 4.85 | 123.39 | 2.72 | 24 | 9.50 | .00 | | 0.0 |
| 180° | 4.70 | 8.50 | 3.80 | 96.68 | 2.13 | 48 | 8.60 | .10 | 4.54 | 4.7 |
| 180° | 4.80 | 8.80 | 4.00 | 101.77 | 2.24 | 24 | 8.90 | .10 | 4.54 | 4.5 |

From Table I it may be seen that water absorption ranged from zero after 24 hours at 140° F. and 160° F. to a maximum of 4.7% after 48 hours at 180° F. These amounts are extremely small in comparison to water absorption of similar samples without wax coating which reaches total saturation in less than 10 seconds under otherwise similar conditions.

EXAMPLE II

This example illustrates the relative compressive strengths of commercial fish boxes made using the cascade wax coating method, the curtain coating method and the process of this invention.

A commercial 60 lb. fish box made from commercially preconditioned paper having a Mullen strength of 275 lbs./sq. inch was then wax coated by using the cascade wax coating method described in Stease U.S. Pat. No. 3,793,056 by the Bartlett Corporation of Anderson, Ind.

A commercial 60 lb. fish box made from commercially preconditioned paper having a Mullen strength of 275 lbs./sq. inch was then wax coated by using the curtain coating process of McConnell U.S. Pat. No. 3,524,759 by Georgia Pacific Company of Owosso, Mich.

A commercial 60 lb. fish box made from commercially available non-conditioned paper corrugated board having a Mullen strength of 200 lbs./sq. inch was then wax coated in accordance with the process of this invention by using Pennzoil Wax No. 8126 at a bath temperature of approximately 200° F. by moving the board through the bath at slightly less than 300 ft. per second for an immersion time of approximately 1–1½ seconds, draining and cooling the box as above described.

These boxes were compression tested by a national test laboratory as follows:

Each box was placed in a steam chest at 90° F.±20° F. at a relative humidity of 90±3% for 72 hours and removed. Each box was then tested for compression resistance by positioning the box between a supporting and a compression force-inducing platen and slowly adding force until the box exhibited vertical deformation. The results on the three boxes are set forth in Table II.

TABLE II

| Curtain Coated Box | Cascade Coated Box | Box Coated by the Process of This Invention |
|---|---|---|
| 1030 pounds | 1643 pounds | 1534 pounds |

The results in Table II show that using inexpensive, non-preconditioned paper having a 32.5% lower Mullen strength, the 60 lb. fish box made in accordance with the process of this invention exhibited slightly greater than 50% more than the crushing strength of the curtain coated box which is the leading commercial fish box now on the United States market. The comparable cascade coated box exhibited only about 6% more crushing strength than the box made using the process of this invention, even though the cascade coated box was made with 275 lbs./sq. inch Mullen test strength corrugated board whereas the box coated by the process of this invention was made using 200 lbs./sq. inch Mullen test strength corrugated board.

In the case of corrugated board having for example, about 125 to about 275 pounds per inch Mullen test rating that is intended for use in iced single wall fish shipping cartons of, for example, 25 pound or 60 pound capacity, it has been found to be desirable to modify paraffin waxes by adding compatible modifiers to thereby increase resultant coating flexibility, grease resistance and glossy appearance and this can be effected by adding a hot melt wax. The amount of hot melt wax may be satisfactorily varied from about 8% to about 35%, by weight of the total mixture. Good results have been obtained by adding to paraffin type waxes a high viscosity petroleum derived hydrocarbon hot melt wax available from National Wax Company of Skokie, Ill. under the trade name Hiflex 100. Hiflex 100 hot melt wax has a congealing point (ASTM D-938) of 150°-156° F. and a needle penetration at 77° F. (ASTM D-1321) of 6.0–8.0 and meets all FDA requirements for components of paperboard in contact with aqueous and fatty foods.

EXAMPLE III

A commercial 60 lb. fish box pre-cut corrugated board blank of untreated corrugated board from Consolidated Packaging Corporation of Flint, Mich. and having a Mullen strength of 275 psi base and 200 psi lid was provided with a wax impregnation coating by advancing the precut blank, at ambient room temperature, i.e., without preliminary heating of the blank, into a wax bath in the 30 foot long tank portion of a wax coating machine of the type shown in FIG. 4 of the drawings, with the flutes in the board parallel to the direction of travel into and through the wax composition at a speed of approximately 150–160 feet per minute, and at a temperature of approximately 200°-210° F. The excess wax was drained back into the tank as the coated, impregnated board exited, and drainage was assisted by air blowing into the flutes and along the outer surfaces of the liners. The board then passed through the stabilization zone in its upward path from the tank and into the following cooling zone before rotating downwardly to receiving slots between brackets 22 on conveyor belt 23, FIG. 4.

The wax composition in the tank was a petroleum based paraffin type modified with a hot melt wax to a composition containing, in weight percent, 18% Hiflex 100 and 82% 9831 wax obtained from National Wax Company.

The wax impregnated board was folded along the scoring lines in the precut blank into a 60 lb. fish box. The bottom panel of that box was tested for wax distribution and pick up in the medium portion, only, which comprises the flutes of that bottom panel, having dimensions of 46.4 inches by 27.4 inches with the flutes running parallel to the side having the shorter dimension. Nine, two inch by four inch samples were cut from the panel at substantially equally spaced locations, in rows of three samples each in a first row along a center line parallel to the short dimension at the middle of the 46.4 inch dimension of the panel and in second and third rows substantially equi-spaced from the first row and approximately 2–3 inches form each end edge of the 46.4 inch dimension of the rectangular panel. In like manner, the center row of three samples lies on a center line parallel to the long dimension at the middle of the 27.4 inch dimension, and the other two rows of samples are equi-distant from the side of the 27.4 inch dimension.

The samples including the liners and the medium were first weighed. The wax was separated from the liner and medium portions of each of the nine samples in a 105° F. wax solvent for seven hours, dried overnight and then reweighed to establish the amount of wax present in both the liners and the medium portions of each sample. The wax distribution in the sample portions was then calculated as a percentage of the total weight of each sample.

The results showed that the hot melt wax additive in the wax composition caused the wax pick up to be increased substantially relative to conventional commercial cascade coated corrugated board. The average wax pick up for the nine samples of the total of the wax on the outer surface of the two liners and on and in the medium was 55.1% of the total weight. This total compares to a conventional pick up of 46 to 49% for cascade coated corrugated board.

The results also showed about an 11% higher wax pick up for the three samples lying along the center line of the 27.4 inch dimension of the panel than the average of the wax pick up in each of the other two rows of three samples adjacent the side edges of the larger dimension of the board and is attributed to drainage run off during cooling.

EXAMPLE IV

In a manner similar to that described in Example III, 60 lb. fish box precut similar corrugated board blanks were wax coated in the same apparatus using a wax composition containing:

16.4% Hiflex 100,
9.1% Panwax 9653, and
74.54% Paraffin wax 6971.

All of these wax components were obtained from National Wax Company. Panwax 9653 is a microcrystalline, petroleum derived hydrocarbon having a drop melt point (ASTM D-127) of 167°-176° F., a needle penetration at 77° F. (ASTM D-1321) of 20–25 and a viscosity at 210° F. (ASTM D-445) of 58.9–70.0 SSU. Paraffin wax 6971 has a melting point of 128°-133° F.

A similar sized and shaped panel was processed through the above stated wax blended composition at a speed of about 116–120 feet/minute and at a temperature of approximatley 200° F.

A commercial 60 lb. fish box made from commercially preconditioned paper having a Mullen strength of 275 lbs./sq. in. by the cascade wax coating method described in Stease U.S. Pat. No. 3,793,056 was sampled in a similar manner and analyzed for wax pick-up in the medium only for comparison to the panel from the 60 lb. fish box made by using the above described wax blended composition.

Seven samples were taken from locations similar to the rows described above for Example III except that the side rows adjacent to the long dimension contained only two instead of three samples each. These samples were analyzed for wax pick up in the medium or flute portions, only, of the corrugated board.

The test results showed that the average wax pick up in the medium of the corrugated board using the modified blended wax composition identified above was 46.7% by weight of the total sample weight. In comparison the average wax pick up from seven similarly located samples taken from the commercial cascade coated board, in the medium only, was 39.2%.

A 60 lb. fish box, with top, processed by using the wax blend of paraffin wax, microcrystalline wax and hot melt wax of this example was compression tested in the manner described above in Example II and the box showed vertical deformation at 1890 pounds.

EXAMPLE V 60 lb. fish box precut similar corrugated board blanks similar to those described in Example III were wax coated in an apparatus and manner similar to that described above in Example III by using another wax blend composition containing:

14.9% Hiflex 100,
17.4% Panwax 9653, and
67.7% Paraffin wax 6971, all wax components being obtained from National Wax Corporation. The wax blend composition had a melt point of about 133° F., a needle penetration at 79° F. of about 15.0 and a Saybolt viscosity at 210° F. of about 59.5 SSU.

The 60 lb. fish box blanks were processed through the tank containing the wax blend composition at a temperature of about 175°-180° F. at a speed of about 110-210 feet/minute.

Thirteen samples were taken from a wax impregnated panel similar in size to that described in Example III and located in three rows of three samples oriented as in Example III with an additional two rows of two samples located approximately equi-distant from the samples in the three rows from both ends of the shorter 27.4 inch dimension side, and from both sides of the longer 46.4 inch dimension side. These samples were analyzed by a similar procedure to determine wax pick up in the medium only and compared to the commercial cascade coated samples described in Example IV.

The test results showed that the average wax pick up of the thirteen samples was 63.2% of the total weight of the mediums in comparison to 39.2% wax pick up of the seven samples of the cascade coated corrugated board, or an increase of 24%. This extremely large and unexpected increase in wax pick up produces a resultant corrugated board, and a resultant iced fish box by folding up such treated corrugated board that represents the preferred form of the articles of this invention.

A wax blend composition having a melt point range of about 115° F. to about 210° F. and a Saybolt viscosity in the range of about 50 to about 70 SSU is particularly suitable for use in making wax blend coated corrugated board for use in iced shipping boxes.

I claim:

1. A wax impregnated, wax coated corrugated containerboard characterized by improved compression strength and resistance to water absorption having at least one corrugated medium spacing each pair of liners, each said liner having interior and exterior surfaces, said corrugating medium being secured at the crests of its flutes with the interior surfaces of said liners and thereby forming parallel open flutes between said liners, said liners and said medium being formed of fibrous paperboard treated with a heated, liquid water resistant agent which penetrates into the interstices between the fibers forming the interior portions of said liners and said corrugating medium and essentially saturates said liners and said medium without impairment of the strength and flexibility of said containerboard, and which agent is solid at ambient temperatures, and all of the external and internal surfaces of said liners and the external surfaces of said corrugated medium being coated with a layer of said agent sufficient to seal the outermost extremities of fibers protruding outwardly from the surfaces of said liners and said corrugated medium, and to make said treated corrugated medium and said liners water resistant.

2. A corrugated containerboard according to claim 1 wherein said water resistant agent is wax.

3. A food product container folded into the form of a box by using the containerboard defined in claim 1.

4. corrugated containerboard according to claim 1 wherein said water resistant agent is a wax blend comprising paraffin wax and a hot melt wax.

5. A corrugated containerboard according to claim 1 wherein said water resistant agent is a wax blend comprising paraffin wax, hot melt wax and microcrystalline wax.

6. A food product container folded into the form of a box using the containerboard defined in claim 1 wherein said water resistant agent is a wax blend comprising paraffin wax and a hot melt wax.

7. A food product container folded into the form of a box using the containerboard of claim 1 wherein said water resistant agent is a wax blend comprising paraffin wax, hot melt wax and microcrystalline wax.

8. A corrugated containerboard according to claim 1 wherein said water resistant agent is a wax blend composition having a melt point in the range of about 115°-210° F. and a Saybold viscosity of about 50 to about 70 SSU.

9. A food product container folded into the form of a box using containerboard of claim 1 wherein said water resistant agent is a wax blend composition having a melt point in the range of about 125°-145° F. and a Saybolt viscosity of about 50 to about 70 SSU.

* * * * *